US005540248A

United States Patent [19]

Drzewiecki et al.

[11] Patent Number: 5,540,248

[45] Date of Patent: Jul. 30, 1996

[54] FLUIDIC SOUND AMPLIFICATION SYSTEM

[75] Inventors: Tadeusz M. Drzewiecki, Rockville; R. Michael Phillippi, Highland, both of Md.

[73] Assignee: Defense Research Technologies, Inc., Rockville, Md.

[21] Appl. No.: 340,899

[22] Filed: Nov. 15, 1994

[51] Int. Cl.[6] ..... F15C 1/04; F15C 1/12

[52] U.S. Cl. ..... 137/14; 137/819; 137/828; 181/0.5; 181/177

[58] Field of Search ..... 137/819, 828, 137/14; 181/0.5, 177

[56] References Cited

U.S. PATENT DOCUMENTS

| | | | |
|---|---|---|---|
| 3,239,027 | 3/1966 | Schuck . | |
| 3,398,758 | 8/1968 | Unfried . | |
| 3,425,430 | 2/1969 | Horton . | |
| 3,500,952 | 3/1970 | Beeken | 137/828 |
| 3,529,615 | 9/1970 | Kishel | 137/828 |
| 3,561,463 | 2/1971 | Beeken | 137/828 |
| 3,666,273 | 5/1972 | Kantola et al. . | |
| 3,683,951 | 8/1972 | Beaumont | 137/819 |
| 3,752,171 | 8/1973 | Syre | 137/819 |
| 3,999,625 | 12/1976 | Pickett et al. . | |
| 4,121,620 | 10/1978 | Pickett et al. . | |
| 4,258,754 | 3/1981 | Pickett . | |
| 4,373,553 | 2/1983 | Drzewiecki . | |
| 4,689,827 | 8/1987 | Gurney, Jr. | 137/828 |
| 4,964,100 | 10/1990 | Srour et al. | 281/0.5 |

OTHER PUBLICATIONS

B. M. Hoffman, "Amplification", 10th Fluidics Symposium, Georgia Tech 1969.

Drzewiecki article "A Fluidic Audio Intercom", ASME 1980, pp. 89–94.

Drzewiecki Ph.D. Thesis "A Fluidic Voice Communication System and Data Link", Mar. 1980, pp. 17–187.

*Primary Examiner*—A. Michael Chambers

[57] ABSTRACT

A fluidic sound amplification system couples successive laminar proportional amplifiers through acoustic radiation between output and input horns to avoid the propagation of null offset signals. A second approach to obviating DC null bias in a fluidic sound amplification system comprises splitting the input signal, effecting a selected time delay on a portion of the signal such that the bandpass frequencies and dead zones or cancellation frequencies respectively of the amplified signals are 180° out of phase and combine to produce a near uniform frequency response. A third approach is to use multiple parallel elements in each stage of amplification in such a manner that mechanical errors cancel each other out.

31 Claims, 16 Drawing Sheets

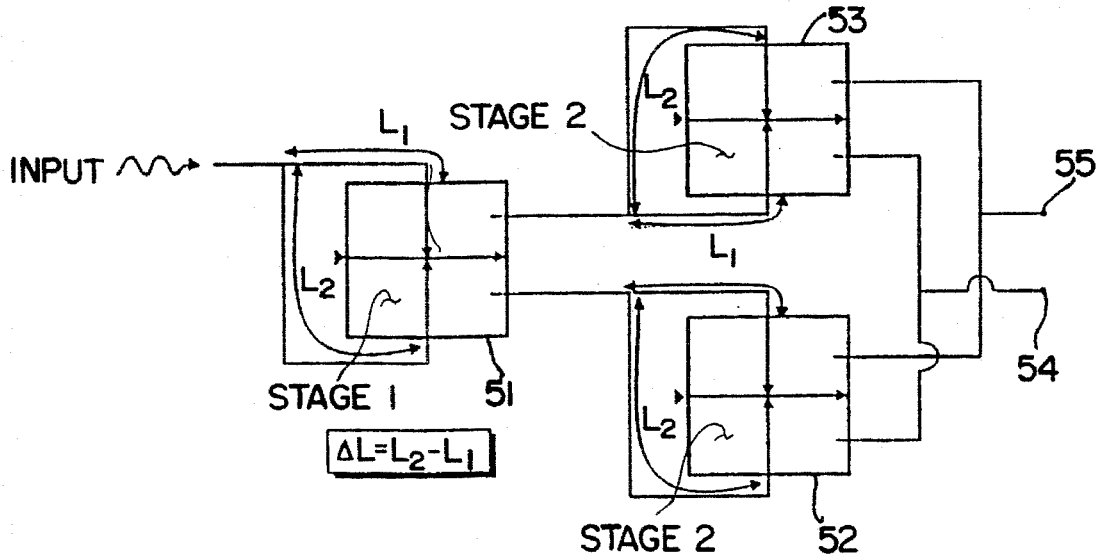
FIG. 5a
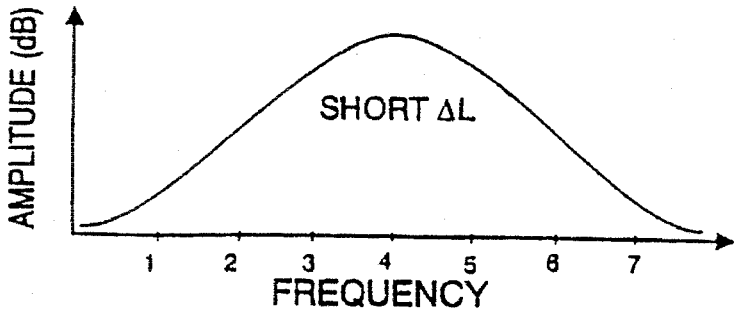
FIG. 5b
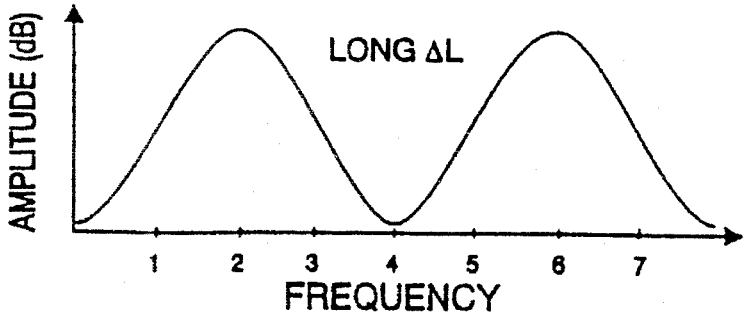

FLUIDIC SOUND AMPLIFICATION SYSTEM

BACKGROUND OF THE INVENTION

1. Technical Field

The present invention relates to methods and apparatus for sound amplification and public address systems utilizing no electricity or mechanical moving parts. In particular, the invention pertains to fluidic acoustic signal amplification.

2. Discussion of the Prior Art

Amplification, processing and transmission of sound has been the object of many inventions in the past, starting with Thomas Edison. Most of these inventions dealt with mechanical, electro-mechanical, and electronic reproduction of the sound signal by converting mechanical vibrations into electrical impulses, in the simplest form, merely coupling the mechanical vibrations directly to resonating boards and the like. Amplification and reproduction of sound by non-electronic, fluidic means was first suggested in U.S. Pat. No. 3,425,430 (Horton). Other patents, such as U.S. Pat. Nos. 3,239,027 (Schuck), 3,666,273 (Kantola et al), 3,398,758 (Unfried), 3,999,625 (Pickett), 4,121,620 (Pickett), 4,258,754 (Pickett) and 4,373,553 (Drzewiecki), also disclose fluidic sound or acoustic amplification systems of one sort or another. However, none or these consider or suggest the difficulty of fluidically processing audio signals in such a way that there is true representation and fidelity of the original signal, both in the amplification system and after the signal has been broadcast to a remote location. This can be seen in the early work by Roffman and Deadwyler on public address systems demonstrated by Horton at the $10^{th}$ Anniversary of Fluidics Symposium at Georgia Tech in 1969. This system, while demonstrating a capability to amplify sound, was limited in bandwidth and produced significant amounts of hiss, noise and distortion.

In many instances it is desirable to amplify, process, transmit and broadcast sound from a single source to a number of receivers or listeners without using electricity, without closing an electrical circuit that would cause the flow of electricity, and without causing or having caused the movement, deflection or distortion of a mechanical member, such as a diaphragm, that might generate heat by friction. Among such instances, but certainly not the only ones, are public address systems in environments wherein heat or spark emissions from electrical elements or moving mechanical parts could cause a fire or explosion; e.g., environments where fuel fumes could easily be ignited, chemical explosive manufacturing plants, oil refineries, paint factories, plastics manufacturing plants, and grain mills where explosions from the extremely rapid combustion of dust and powder are a constant danger. Other instances where it is undesirable to have any electrical or electronic components include fail-safe operation of an audio system in environments threatened by interference from electromagnetic or nuclear radiation. Further, at facilities where radiation hazards exist, it is often difficult and very expensive to harden electronics sufficiently to withstand existing radiation levels. A non-electronic system that is inherently immune to radiation would greatly improve the safety of operations at such facilities. There are other instances where electricity simply cannot be used at all because of moral or religious teachings. In Judaism, strict orthodox interpretations of the Talmud proscribe the use of electricity on the Sabbath and Holy Days. The Amish have similar prohibitions against electricity in their daily lives. In places of worship where large congregations must be accommodated, communicants performing religious rites often cannot be heard in the far reaches of the building without excessive efforts resulting in a strain on their voices. Elderly and hearing impaired congregants in such situations can be denied active participation in their religious obligations.

Although fluidic amplification of sound is well-known, there is no practical fluidic system capable of providing reasonably good to high fidelity with adequate sound level to project the sound into large spaces in a manner comparable to conventional electronic devices. Hiss and background noise can be eliminated by using second generation laminar fluidic amplifiers, the laminar proportional amplifier, LPA, as described by Drzewiecki in an article "The Fluidic Audio Intercom" published by the American Society of Mechanical Engineers in its Proceedings of the Twentieth Anniversary of Fluidics Symposium, Chicago, Ill., 1980. This device can provide essentially noiseless, distortionless amplification of sound up to frequencies of about 5000 Hz. However, unlike the response of a microphone diaphragm directly deflected by the sound pressure wave, sound impinging on the input port of a fluidic amplifier creates a flow that interacts with and deflects a laminar stream. In terms of pressure (i.e., loudness) amplification, this is not very efficient due to the low pressures required to maintain laminar, noiseless flow. After the sound is amplified and coupled to the atmosphere (i.e., broadcast), sound pressure losses occur when the high level sound over a small exit area is issued from a much larger area, as out of an exponential horn.

It is clear that to provide effective fluidic sound amplification a great deal of gain is necessary, much more than if the pressure were directly amplified. The total gain needed must be sufficient to raise the original sound level plus the amount needed to overcome the input and output losses. Gain in excess of 100 (40 dB) requires three or more stages of fluidic amplification. This gives rise to a further problem, the inherent amplification of the DC null offsets needed to correct the inevitable imperfections and asymmetries in the fluidic elements. A one-percent offset is considered good even for high precision manufacturing techniques, but such offset in the initial stage will saturate the third stage when the gain in the two succeeding stages is 50 or more (assuming a maximum recovered output, saturation, of 50 percent).

OBJECTS AND SUMMARY OF THE INVENTION

Therefore, in light of the above and for other reasons that will become clear from the following description, it is an object of the present invention to provide amplification of speech and other sounds, such as music, in a fully intelligible manner by using fluidic amplification and processing of the audio and acoustic signals without the use of any electrical, electronic or mechanical means, but rather by sound-modulating the flow of a gas in a fluidic circuit solely powered by pneumatic or gas pressure.

It is a further object of the present invention to provide means for broadcasting amplified sound into large spaces over distances on the order of hundreds of feet, in order that large numbers of people located at some distance from a speaker, musical instruments or other sound source can hear the sound at normal levels sufficient for understanding and appreciation thereof.

It is yet a further object of this invention to provide a fluidic system, operable without moving mechanical parts such as diaphragms, membranes or pistons, to process, amplify and project audio signals.

It is still a further object of this invention to provide a public address system operable without electricity in any form.

Finally, another object of the invention is to provide high gain acoustic-fluidic amplifiers having high fidelity.

The aforesaid objects are achieved individually and in combination, and it is not intended that the invention be construed as requiring that two or more of said objects be combined.

The present invention is concerned, in part, with methods and apparatus for staging fluidic amplifiers to permit assembling gainblocks with very high gain (greater than 1000:1) necessary for an audio amplification system suitable for public address, without the usual difficulties of excessive feedback, supply noise, and compensation for the saturating effects of null offset. Furthermore, previous attempts to achieve desired sound pressure levels (loudness) by increasing amplifier gain or pressure level, have not succeeded due to the considerable distortion associated with high sound intensity levels. The present invention obviates this problem by introducing into fluidics the concept of phased amplifier output arrays. These arrays match moderate level outputs over many small areas with small expansion ratios to produce a much greater effective signal without the usual attenuation due to large expansion ratios.

Fidelity is maintained using an amplifier with uniform response over the frequency range of interest by eliminating and cancelling resonances and filling-in of notches with tuned acoustic lines, resonators, reflectors and other passive acoustic circuits. The device provides the fluidic equivalent of an equalizer to permit the selection of a frequency response to please specific listeners' tastes. In addition, since it is often desirable to broadcast sound from a single point rather than distributing the signal over transmission lines, the problem of overpowering those persons close to the speakers is solved by a unique cancellation technique involving the use of out-of-phase outputs that cancel in the near-field yet beat and add in the far field. By using the opposite outputs of a differential laminar proportional amplifier (LPA), whose responses are 180° out-of-phase with each other, and making pairs of out-of-phase speakers this effect can be made to cover very large areas. The effect of broadcasting in this manner is such that the audience near the speaker basically hears the speaker's voice alone, unamplified, yet in the far-field, with the addition of the amplified signals, the loudness is increased to the level that it was generated at the source.

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components.

BRIEF DESCRIPTION OF THE DRAWINGS

FIG. 5*a* is a schematic diagram illustrating an alternative technique of staging LPAs according to the invention.

FIG. 5*b* shows the frequency response of a two-stage gain block using the staging method shown in FIG. 5*a*.

DESCRIPTION OF THE PREFERRED EMBODIMENTS

Figure 1:
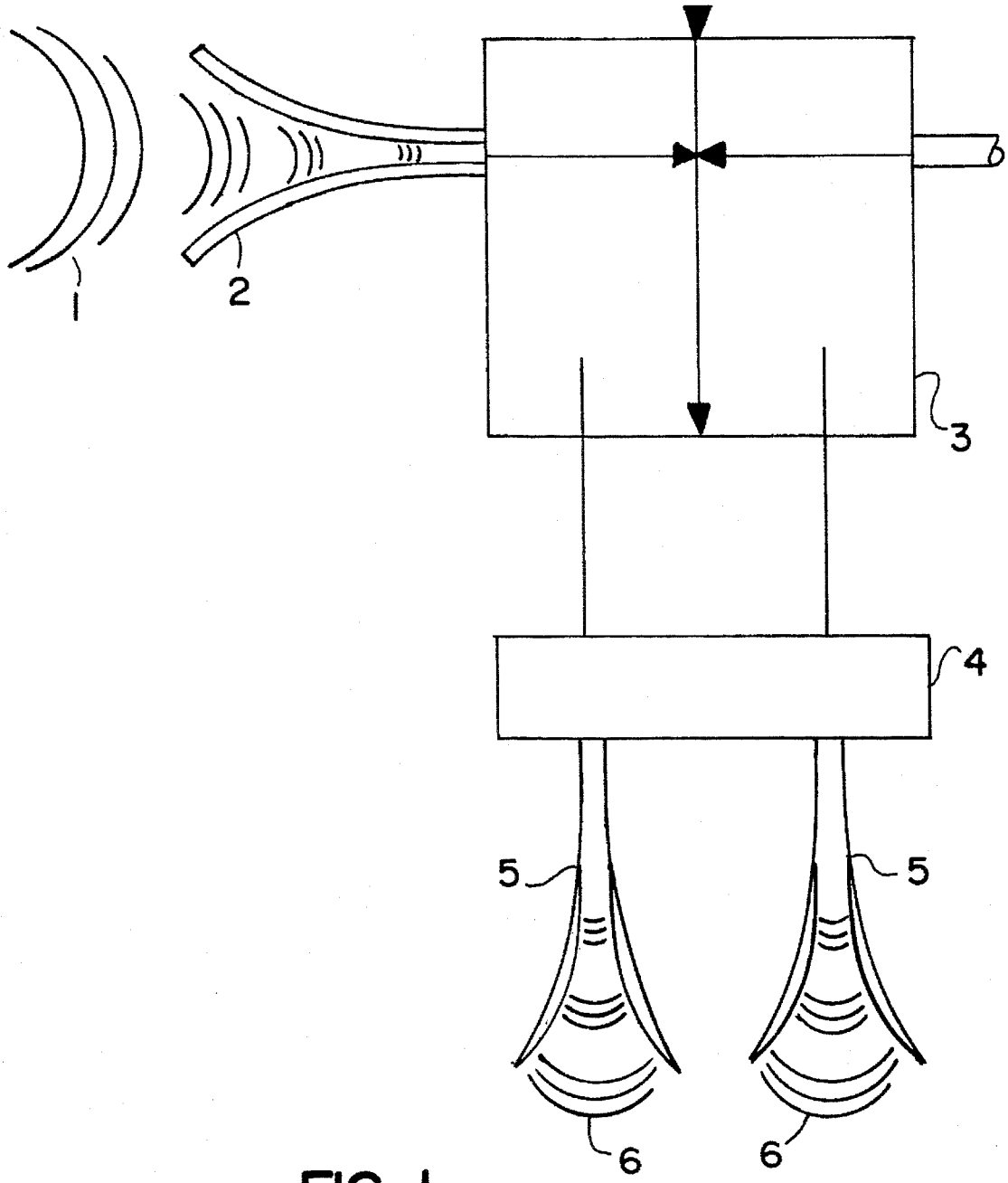
FIG. 1 is a schematic diagram of an audio amplification system of the present invention.

Referring specifically to FIG. 1, input sound waves 1 enter a matching input horn 2 acting as a transformer to increase the sound level (i.e., the acoustic signal pressure) applied to fluidic amplifier 3. The finite input impedance of fluidic amplifier 3 reduces the input sound pressure and generates an input flow that interacts with the laminar fluid power stream of the first amplifier stage. Amplifier 3 may be plural stages wherein the input signal is amplified and then applied to a compensation network 4. This may comprise passive lead, lag, lead-lag, or lag-lead circuits but also can include acoustic elements such as resonators to boost gain or fill in notches, and destructive interference cancellation chambers to attenuate unwanted resonances. The final signal is fed into matching output horns 5 for matching the high pressure amplified signals into lower pressure, wide area signals 6 that are broadcast to listeners.

Figure 2:
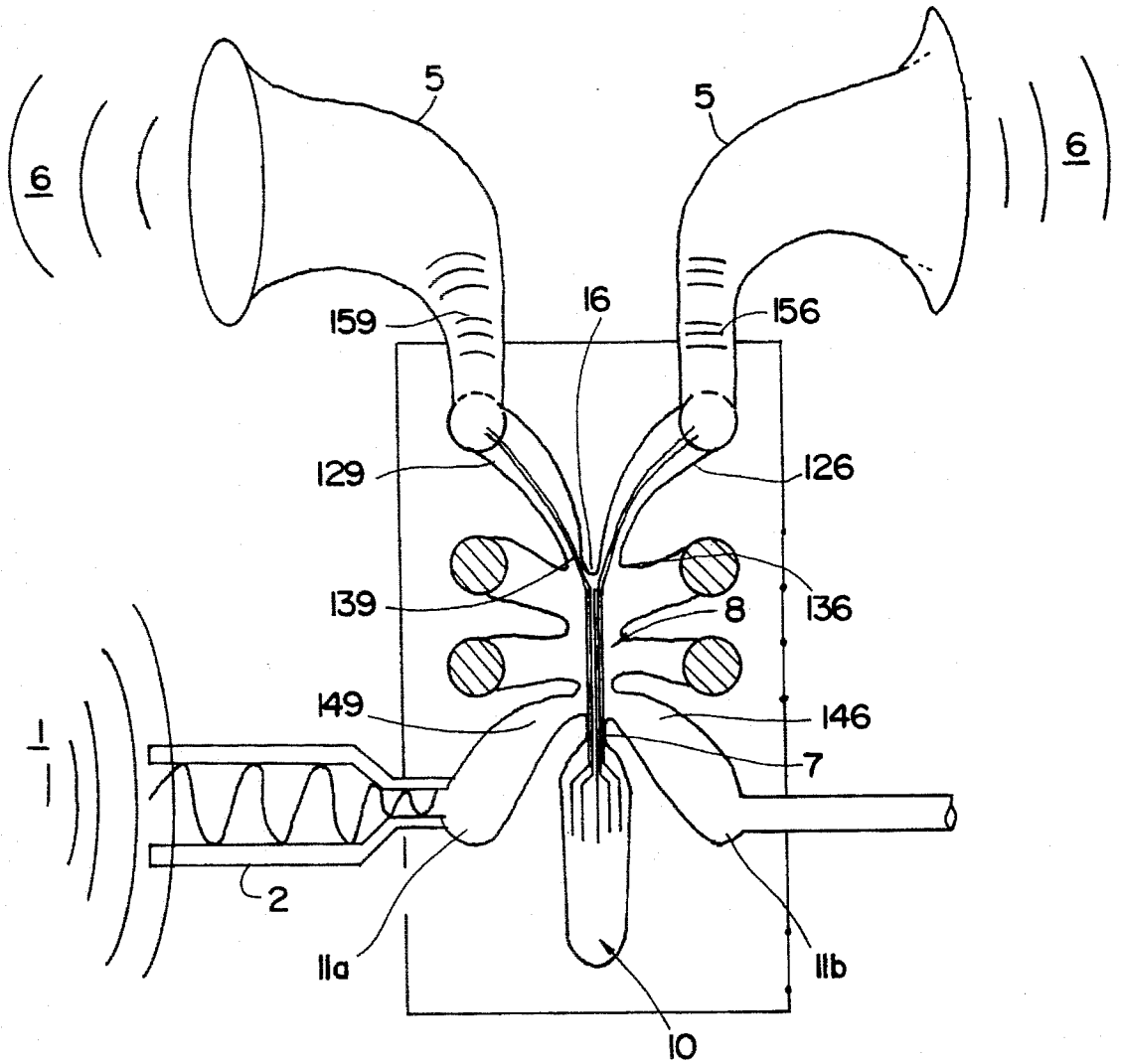
FIG. 2 is a partially diagrammatic plan view of a laminar proportional amplifier (LPA) employed in the system of the present invention.

Operation of a single stage laminar proportional amplifier (LPA) is depicted in FIG. 2. The basic amplifier is comprised of a planar nozzle 7 and other planform geometry typically, but not necessarily, sandwiched between parallel top and bottom plates separated by a distance h. A laminar power stream 8 of fluid, typically air (but may be liquid as when broadcasting underwater) under pressure, issues from nozzle 7 into a vent region 9 of constant ambient pressure when the plenum or supply chamber 10 is pressurized with a supply pressure. In order to maintain laminar flow, the power stream Reynolds number based on the plate separation dimension h must be less than 1400, thereby prescribing the supply pressure. A useful rule of thumb for calculating the Reynolds number $N_{Rh}$ for air having a supply pressure $P_s$ at ordinary room temperature conditions is:

$$N_{Rh}=1000\cdot h(mm)\cdot[P_s(torr)]^{1/2}.$$

where $N_{Rh}$ is the Reynolds Number, h is the separation distance in millimeters between amplifier top and bottom plates, and $P_s$ is the supply pressure in torr.

In order to ensure that the power stream flow is always laminar, a safety factor can be used and the nominal Reynolds number is chosen to be 1000. Thus the supply pressure for nominal operation is inversely proportional to the square of the amplifier top and bottom plate separation distance h, so that:

$$P_s(torr)=1/[h(mm)]^2.$$

For sound amplification applications the width $b_s$ of nozzle 7 is usually on the order of 0.25 mm. In the absence of input sound through left inlet port 11*a*, laminar stream 8 impinges on outlet splitter 16 and enters left output channel 12*a* and right output channel 12*b* essentially equally developing a pressure at the inlets 13*a*, 13*b* of respective outlet channels 12*a*, 12*b*. This pressure is dependent on the velocity (kinetic energy) of the fluid stream. Flow that is not transmitted through the outlet channels is vented via vent passages 9. The right inlet port 11*b* is connected to ambient so that when only ambient pressure is present at the left inlet port 11*a*, there exists no deflecting pressure differential across power stream 8. When sound or any other pressure signal of a frequency within the bandwidth of the amplifier is impressed on left inlet port 11*a*, flow moves through inlet channel 14*a* and impinges on fluid stream 8. The pressure of this flow from inlet channel 14*a* deflects fluid stream 8. Since the pressure at inlet port 11*b* is constant and ambient, the pressure differential is solely determined by the amplitude of the input signal at inlet port 11*a*. The deflected stream 8 impinges more on outlet channel inlet 13*b* and less on the outlet channel inlet 13*a* (i.e., 180° out of phase), creating a pressure difference that may be ten to twenty times higher than the input sound or pressure level. The alternating output pressure signals 15*a* and 15*b* may be transmitted through the outlet channels 12*a*, 12*b*, respectively, to another LPA where the resulting differential signal deflects the next amplifier's fluid power stream.

It is important to note that the output signal rides on a bias pressure level determined by the undeflected pressure recovery. Small imperfections in the symmetry of nozzle 7, the symmetry of outlet splitter 16, and differences in widths of the inlets 13*a*, 13*b* can cause a slight differential output pressure signal to exist without the presence of an input signal. This signal is called null offset and is detrimental to the operation of the LPA in that it limits the number of stages that can be put together without driving an output stage into saturation. In applications where DC operation is not important, it is known to shunt the DC level off through an auxiliary channel disposed to the side of outlet channels 12*a*, 12*b*. Due to the finite impedance of such channels, the null offset is never completely eliminated. However, in cases where only moderate amounts of gain (e.g., <100:1) are required, they work fairly well up to a certain frequency whereupon the signal reflected from the open end comes back and destructively interferes with the input signal causing notching in the frequency response which also can be detrimental.

Figure 2A:
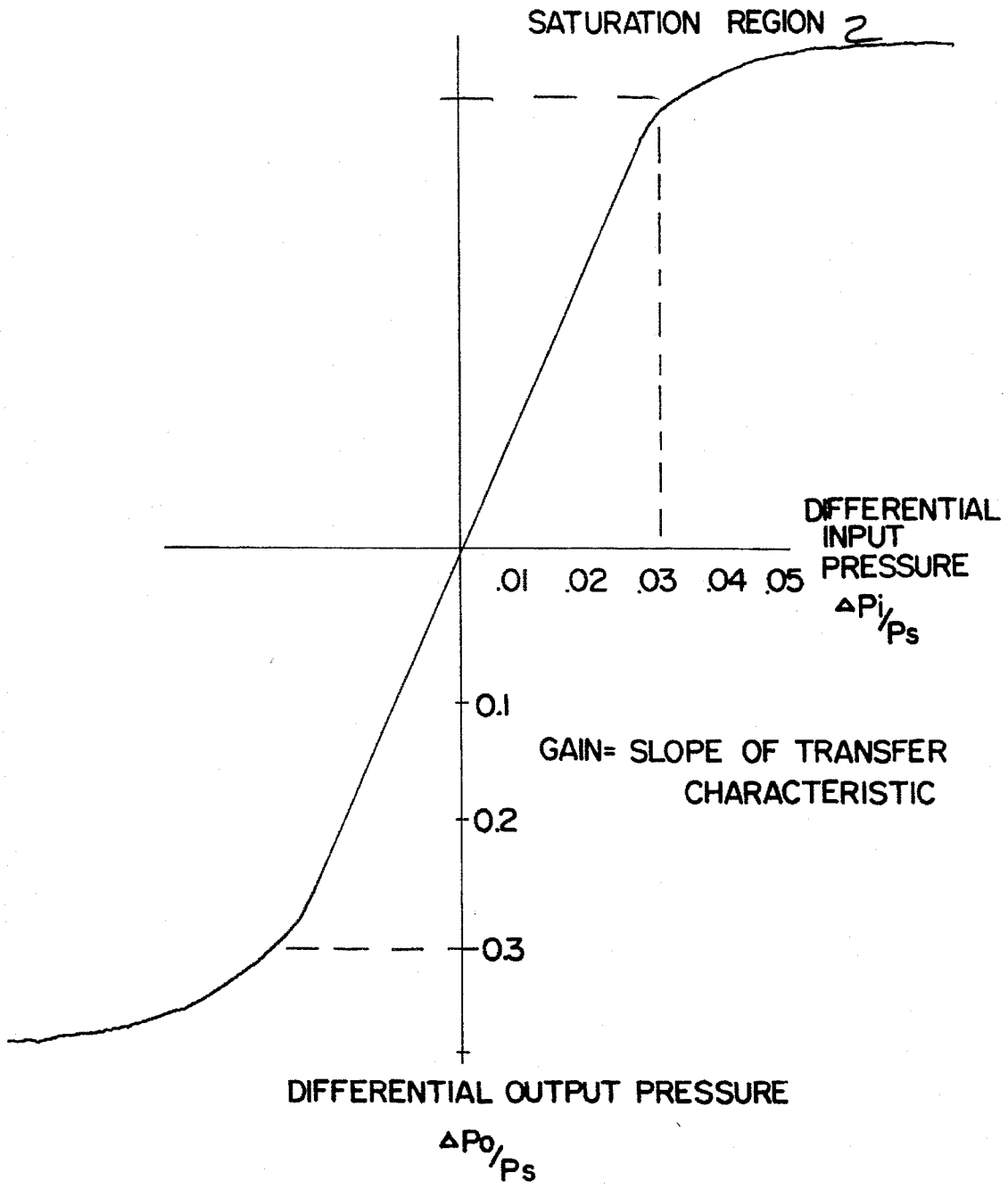
FIG. 2*a* is a typical plot of the static transfer characteristic of an LPA.

FIG. 2*a* shows the static transfer characteristic of an LPA. This curve represents the change in differential output pressure as given by the normalized output pressure (i.e., output pressure divided by supply pressure) when no flow is allowed out of the outlet channels, in response to an applied pressure at the LPA inlet 11*a*. This characteristic is representative of LPAs of any basic dimension. The output signal is linearly related to the input signal to a point where the output differential is twenty-five to thirty-five percent of the supply pressure, corresponding to input signals that are 2.5 to 3.5 percent of the supply pressure. This is the region of distortionless operation. When the input signal becomes larger than 3.5 percent of the supply pressure, the output differential pressure increases less rapidly and eventually saturates at an input signal level of about ten to fifteen percent of supply.

Figure 2B:
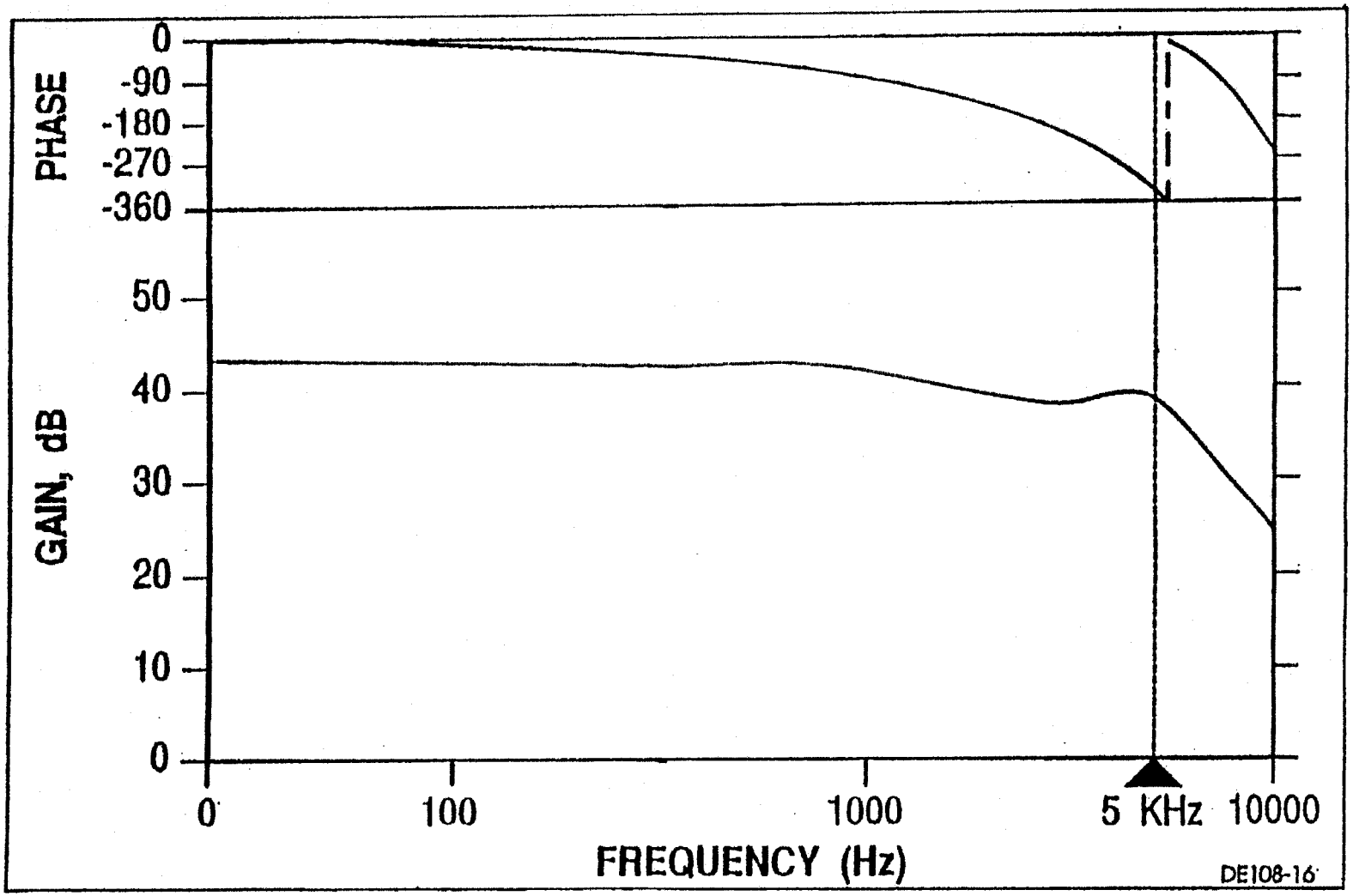
FIG. 2*b* is a plot of the frequency response characteristic of an LPA (i.e., phase and gain versus frequency).

In order to show the frequency response of a large number of different size LPAs, the frequency is normalized with respect to supply pressure and nozzle width. FIG. 2*b* shows a representative frequency response characterized by a high gain at moderate frequencies, followed by a dip followed by a resonance (and accompanying 360° phase shift) associated with the input dynamics and then followed by a general roll-off with resonances associated with the splitter edgetone eigenfrequencies (not shown). The full description of the dynamics of an LPA can be found in Drzewiecki's Doctoral thesis, "A Fluidic Voice Communication System and Data-Link," US Naval Postgraduate School, Mechanical Engineering Department, Monterey, Calif., March, 1980. In order for true fidelity to be achieved, it is important to minimize the non-uniformity of this response characteristic. Based on the observation that the normalized bandwidth has a value of roughly 0.03, then it is clear that frequencies of about 5000 Hz are possible when nozzle width and height are of the order of 0.25 mm and the supply pressure is of the order of 16 torr.

Figure 3:
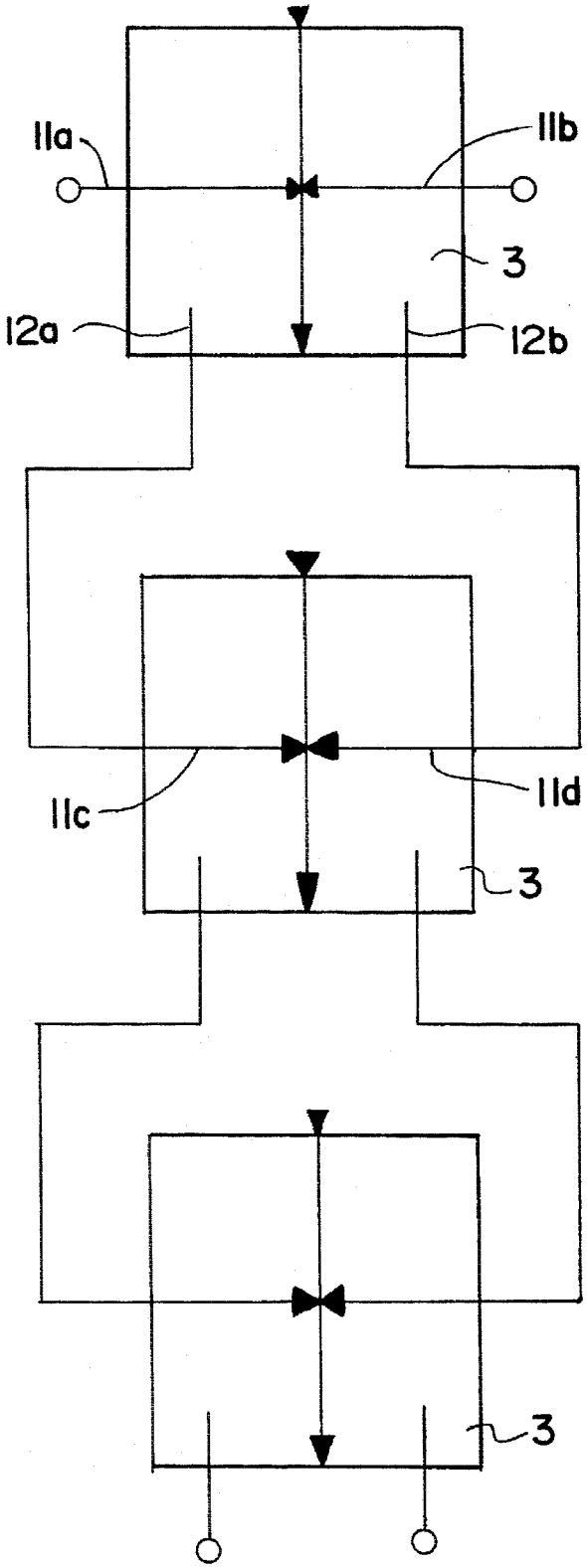
FIG. 3 is a schematic diagram of LPAs cascaded in accordance with prior art techniques.

FIG. 3 illustrates the conventional method of staging LPAs. The output channels 12*a*, 12*b* of the first stage are directly connected to the inlet channels of the second stage 11*c*, 11*d*. The output channels of the second stage are connected directly to the input channels of the third stage, and so forth. Any small null offset in the first or succeeding stages gets amplified by the stages succeeding the offset, and can very quickly be so large as to saturate the final output stage. The null offset propagation thus requires a trim or balancing input signal, usually achieved by attaching a valve or trim resistor to the opposite (i.e., grounded) inlet 11*b* in FIG. 2. This is not altogether satisfactory because the trim may drift with temperature and it introduces a mechanical part that can fail.

Figure 4:
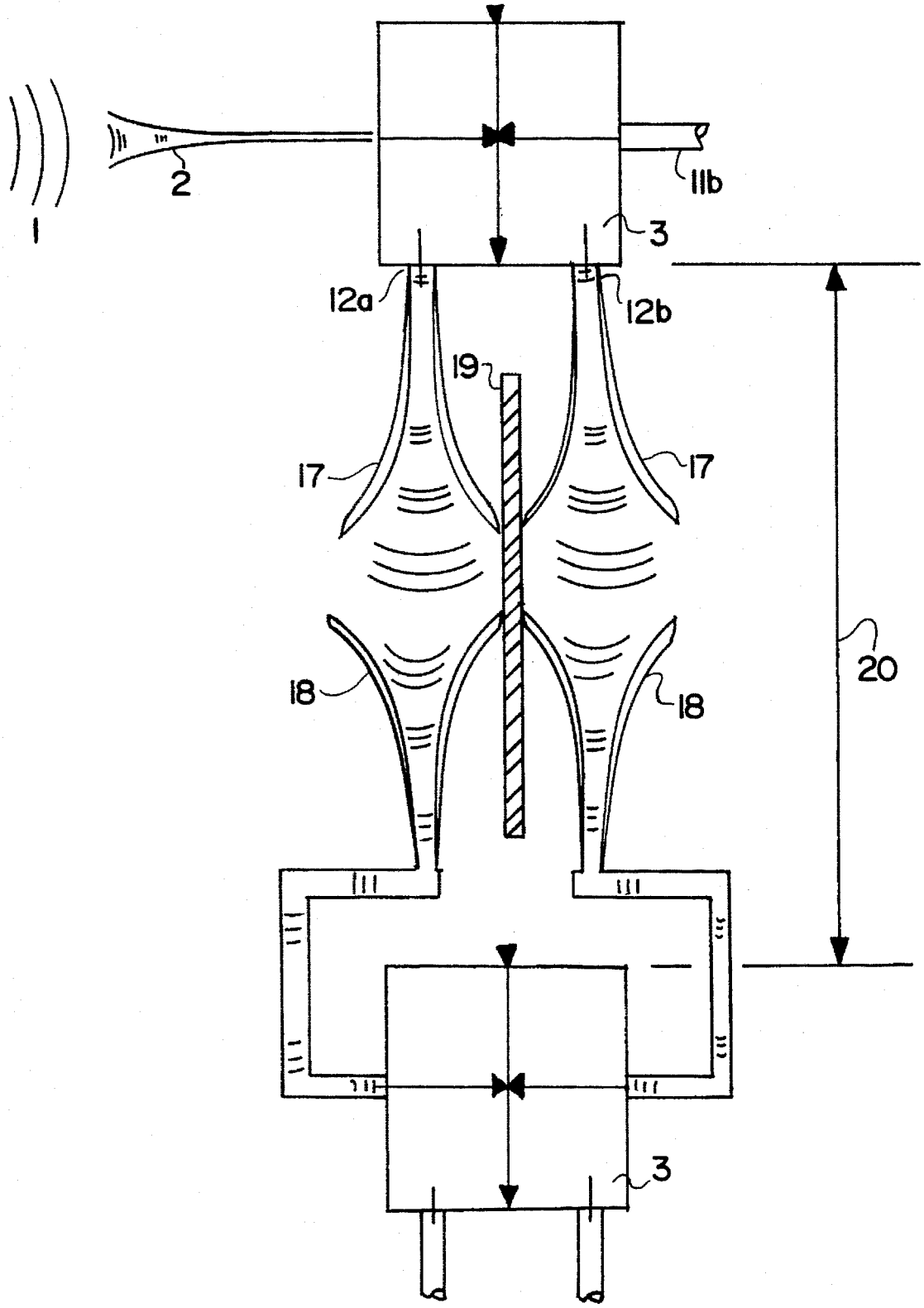
FIG. 4 is a schematic diagram of LPAs cascaded pursuant to the present invention so that DC offsets are not propagated from stage to stage.

The present invention obviates the need for trimming by allowing the output signals of each stage to radiate into space through miniature outlet horns 17 shown in FIG. 4. In this manner all the DC flow out through outlets 12*a*, 12*b* is dissipated and only the AC or acoustic portion of the signal is transmitted and received by miniature inlet horns 18 on the next stage. While pressure amplitude is lost in passing the output signals through the outlet horn into open space, it is restored by the next stage. Losses are somewhat greater in this process than in direct coupling because some of the energy leaks through the output signal side lobes which are not captured by the inlet horns. Again, however, gain is easily attained, and as long as the null offset never propagates, as much gain as is needed can always be produced. In this manner, hands off operation of very high gain systems can be achieved. The major drawback is that DC signals cannot be propagated; however for a sound system this is of little or no concern.

In order to prevent cross-coupling of the out-of-phase signals as they are broadcast from one stage to the next, a separator plate 19 is provided to physically isolate one side of the amplifier from the other. In a stacked arrangement, the spaces 20 between stages would appear generally as shown in FIG. 4. In order to minimize losses, however, this radiation coupling need only be implemented after every other stage, since usually two stages can operate without ever being saturated by normally encountered null offsets. This makes it convenient for using two amplifiers to buffer compensation networks.

Figure 5:
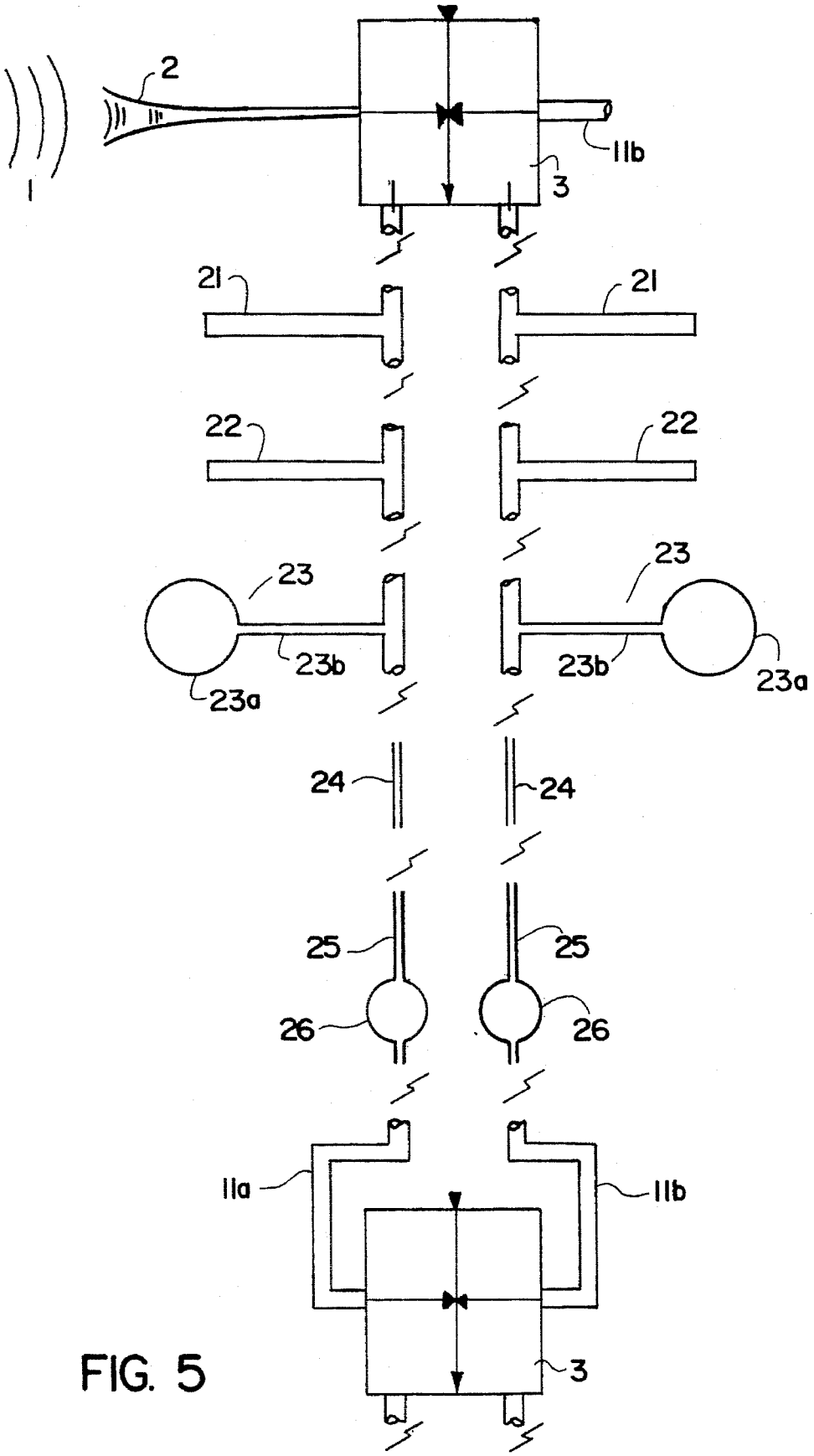
FIG. 5 is a schematic diagram of a compensation network for equalizing processed signals according to the present invention.

To compensate for non-uniformities in the frequency response, that is, differences in gain at different frequencies, circuits such as that shown in FIG. 5 can be used between stages that are directly coupled. The circuit shown is a broken composite of several that may be used and illustrates the type of components used. Resonance tube 21 provides signal cancellation when the signal reflected along its length comes back out of phase (180°, 540° etc.) with the input signal. This narrow band filter is the heart of the equalizer. By using tubes of different lengths, different frequencies can be attenuated. By using telescoping tubing, the tube length can be adjusted so that any frequencies can be notched. The degree of attenuation is a function of the amount of parasitic resistance in the tube and can be selected by adjusting the tube diameter. High gain regions and resonances can be attenuated with this part of the circuit.

A simple lead circuit is obtained from an open ended tube 22. At low frequencies tube 22 acts as an inertance component in series with a resistance so that when it is tee-connected from the output channels of the amplifier, signals passing between the amplifiers will increase as the impedance of the tube increases with frequency. When the frequency becomes sufficiently high and the rarefaction wave reflected from the open tube end comes back out-of-phase, destructive interference occurs as with closed blocked tube 21 except at a higher frequency because the rarefaction provides a 180° phase shift. Thus, it is not until 360° of phase shift occurs (i.e., three times the frequency for the same length) that the signal comes back with 540° of phase shift to cause interference.

A Helmholtz resonator 23, comprising a dead headed volume **23*a* fed by a parallel-connected inertance tube 23*b***, is a second-order resonator that adds gain at a particular frequency. The quality factor, Q, of the resonance is affected by the amount of resistance in the inertance tube, since resistance lowers and broadens the resonant peak. Such a circuit is useful in boosting the gain in regions of low gain as found in the typical LPA response characteristic.

An in-line capillary tube 24 acts also as a resistance and inertance but is connected in series with the amplifier output channel; capillary 24 provides a single-pole lag and serves to limit bandwidth. Another bandwidth limiting lag is achieved by the capillary resistance 25 connected in series with a volume 26 in-line with the amplifiers to form a simple first order RC filter.

Another method for eliminating the effects of null-biases according to the invention is based on a novel application of time delay phase-shifted cancellation. It has been shown that one way to eliminate the saturating effects of wind at one input port of a differential fluidic amplifier is to allow the signal to be imposed on both input ports in such a way that the distance over which the signal must travel to each side is different. In this manner low frequency signals arrive with essentially the same phase, because the phase shift due to the time delay resulting from the distance difference is relatively small and, when imposed on opposite controls of a differential amplifier, the signals cancel each other out. Thus, regardless of the wind velocity or pressure, the resulting output differential is near zero. At high frequencies, however, the small time delay represents an increasingly significant phase shift. At some frequency this shift is equivalent to 180° of phase and the signals imposed on the two controls are out of phase. However, the amplifier operates on the difference signal, which is twice the amplitude on one side. Consequently, at a frequency where the path length difference causes a phase shift of 180° (and harmonics 360° apart), the amplifier passes a maximum signal; when the phase shift is in multiples of 360° the signals cancel. Thus over a given frequency band there may be regions of bandpass (180° shift) and regions of null or no signal (360° shift).

Signal phase shift is the ratio of the time delay (the difference in length divided by the speed of sound) to the period of the wave (i.e., the inverse of frequency). The frequency (and harmonics thereof) at which 180° phase difference occurs is:

$$f_{180}=(2n-1)c/[2\Delta L];\ n=1,2,3,\ldots$$

where c is the speed of sound, n is the harmonic number, and ΔL is the length difference. This is the bandpass condition. Similarly, $$f_{360}=(2n)c/[2\Delta L];\ n=1,2,3,\ldots$$

defines the null or no signal condition.

For a length difference of 10 cm and the speed of sound in air of 333 m/s the center of the passband is 1666 Hz. The width of the passband (the frequencies at which the signal is down 6 dB or halved) is equal to the primary center frequency. Thus the bandpass of the example is from 833 Hz to 2500 Hz.

Note that the differential fluidic amplifier has two output ports, that the output signal X rides on a DC level equal to the recovered pressure, and that this DC level may be slightly different in each output signal due to slight variations in output channel width, height or resistance. Consequently, when these signals are delivered to another amplifier input port the difference in DC level causes a biasing that deflects the jet in that amplifier. If each output is treated individually and the signal is split and differenced in separate subsequent parallel amplifiers, and further if the in-phase output signals are then combined to provide amplified signals to two output ports again, then staging is accomplished without passing DC null biases. FIG. **5*a* shows this novel staged fluidic amplifier circuit 50**.

Referring to FIG. **5*a*, the input signal is delivered to the left input port of first stage amplifier 51 through a signal path having a length $L_1$. The right input port for amplifier 51 receives the same signal via a longer signal path having a length $L_2$. The value of $L_2$–$L_1$ is selected to produce a 180° phase delay at the right input port relative to the left port at a signal frequency corresponding to the center of the desired passband. Thus, when the pressure (or flow) amplitude is at a maximum in the desired passband at the left input port, the amplitude is at a minimum at the right input port. The net effect is reinforced deflection of the power jet of amplifier 51 toward the right output channel. The resulting signal in this channel is applied to the left input port of a second stage amplifier 52 via a signal path having a length $L_1$. That same signal is applied to the right input port of amplifier 52 via a longer signal path having a length $L_2$. This same path length difference results in maximally reinforced power jet deflection to the right output channel in amplifier 52** at the center frequency of the passband.

A further second stage amplifier 53, connected in parallel to amplifier 52, receives signals at its input ports from the left output channel of first stage amplifier 51. In amplifier 53, however, the signal applied to the right input port passes through a signal path having length $L_1$, and the signal applied to the left input port passes through a path having length $L_2$. When the signal in the right output channel of amplifier 51 is at maximum amplitude, the signal in the left channel is at minimum amplitude. Accordingly, the right input port of amplifier 53 receives a minimum amplitude signal when a maximum amplitude signal is received at the left input port of that amplifier. The power jet of amplifier 53 is thus maximally deflected to the right output channel. It will be recalled that, at this same instant of time, the power jet in amplifier 52 is maximally deflected to the right output channel. The two right output channels of second stage amplifiers 52 and 53 are tied together to combine these two in phase signals at port 54 in additive relation.

In like manner, it will be appreciated that the signals in the left output channels of second stage amplifiers 52 and 53 are in phase and are additively combined at output port 55. The differential signal (pressure or flow) across output ports 54 and 55 is thus amplified in the passband of interest.

Figure 5C:
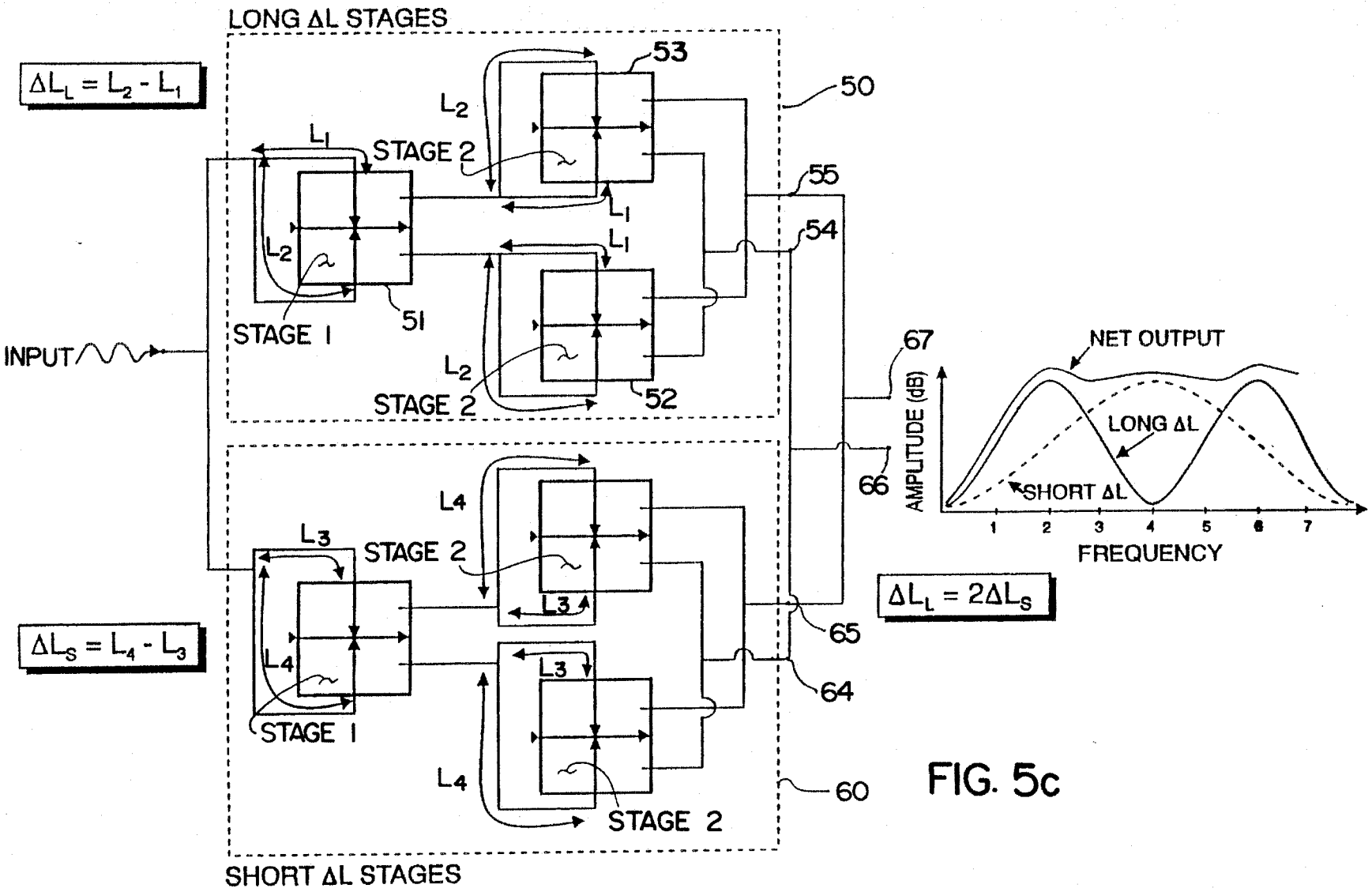
FIG. 5*c* is a schematic diagram of a further embodiment of LPA staging according to the invention.

The differences in length and corresponding phase delay in each set of amplifiers can be varied from short to relatively long to produce output responses as shown in FIG. 5*b*. By designing parallel sets of amplifiers having complementary outputs (that is, having the primary passband of the first set correspond to the dead zone of the second set, and vice versa), a near-uniform frequency response can be achieved across a desired passband, with each set of parallel amplifiers filling in the null or canceled band of the other, as illustrated in FIG. 5*c*.

Amplifier circuit 50 having a relatively long signal path difference, $\Delta L_L = L_2 - L_1$, corresponding to a bandpass condition (180° shift) in the desired frequency range, is staged in parallel with a similar circuit 60 having a relatively short signal path difference, $\Delta L_S = L_4 - L_3$, corresponding to a cancellation or null condition (360° shift) in the same frequency range. The input signal is split between the two circuits and circuit 50 operates to produce an output signal corresponding to the short $\Delta L$ output response illustrated in FIG. 5*b*. Circuit 60 produces an output corresponding to the long $\Delta L$ response of FIG. 5*b*. The minimum amplitude signals, combined at ports 54 and 64 respectively of circuits 50 and 60, are additively combined at port 66 and the maximum amplitude signals combined at ports 55 and 65, are also additively combined at port 67. Since the outputs of the two combined circuits are complementary in the desired frequency range, the net combined output is near uniform in frequency response, as shown in the figure. Additional parallel circuits having other signal path differences can be added to such staging to increase bandpass width or uniformity.

Figure 6:
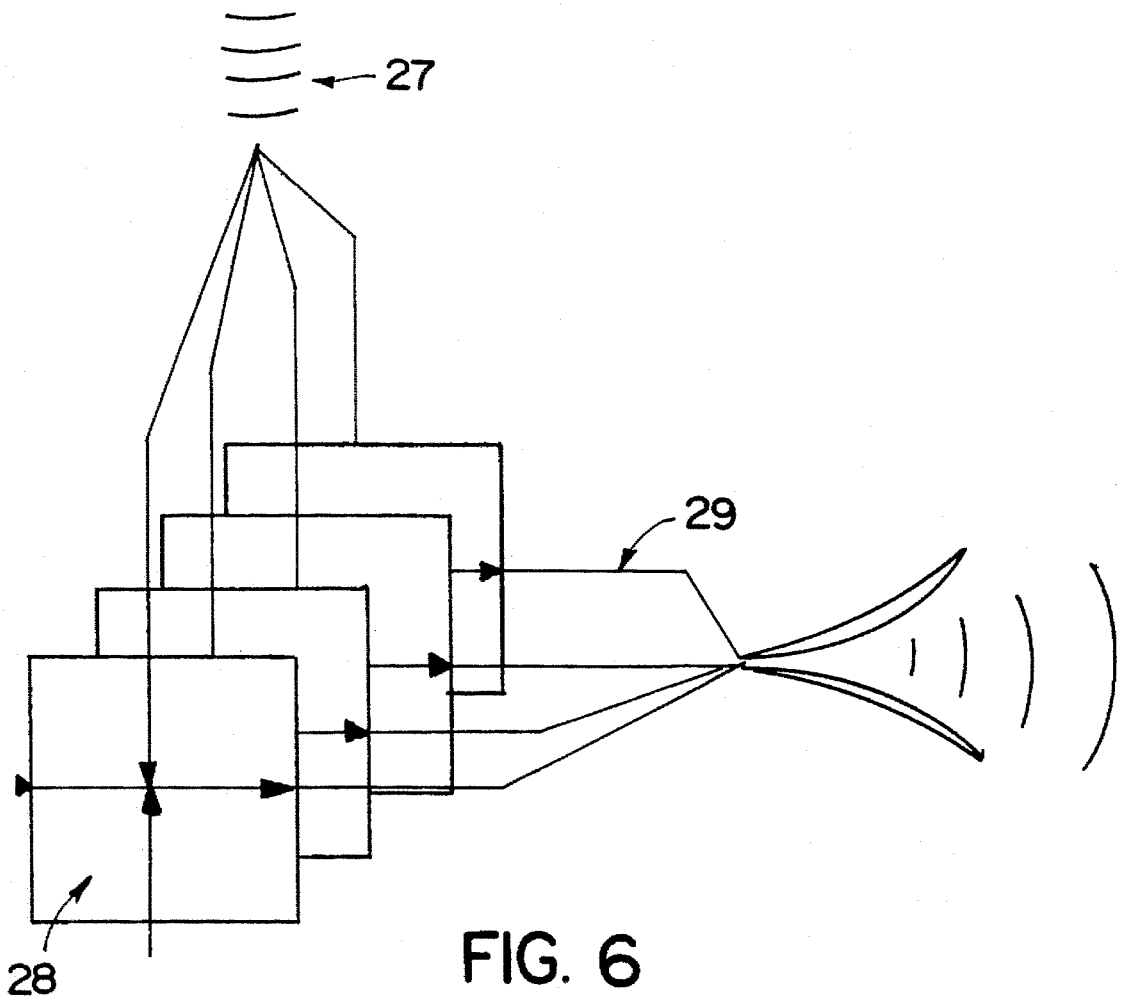
FIG. 6 is a schematic diagram illustrating the method for increasing output power of a single stage of LPAs according to the present invention.

One key to attainable loudness at the output channels of the fluidic amplifier is the delivered acoustic power. Since power is the product of pressure and flow, one way that power can be increased when pressure amplitude must be limited is by providing multiple parallel amplifiers. FIG. 6 shows that fluidic amplifiers in laminate format can be stacked one atop the other to deliver more flow for a given pressure amplitude. The input acoustic signal 27 enters the parallel amplifiers 28, is divided equally among them and amplified, and is then recombined at the output channels 29 so that the effective pressure gain is the same as for a single lamination. However, the flow is a multiple N of that provided by a single stage, where N is the number of parallel stages. By increasing the number of parallel stages, the impedance of the amplifier is decreased, thereby tending to load down the driving stage and decrease the pressure gain of the gainblock while increasing the flow gain. Paralleling amplifiers in such a way that mechanical biases cancel each other out, is also a way of eliminating the null offset effects. When as few as two parallel amplifiers are used, null offset can be reduced by a factor of ten.

Figure 7:
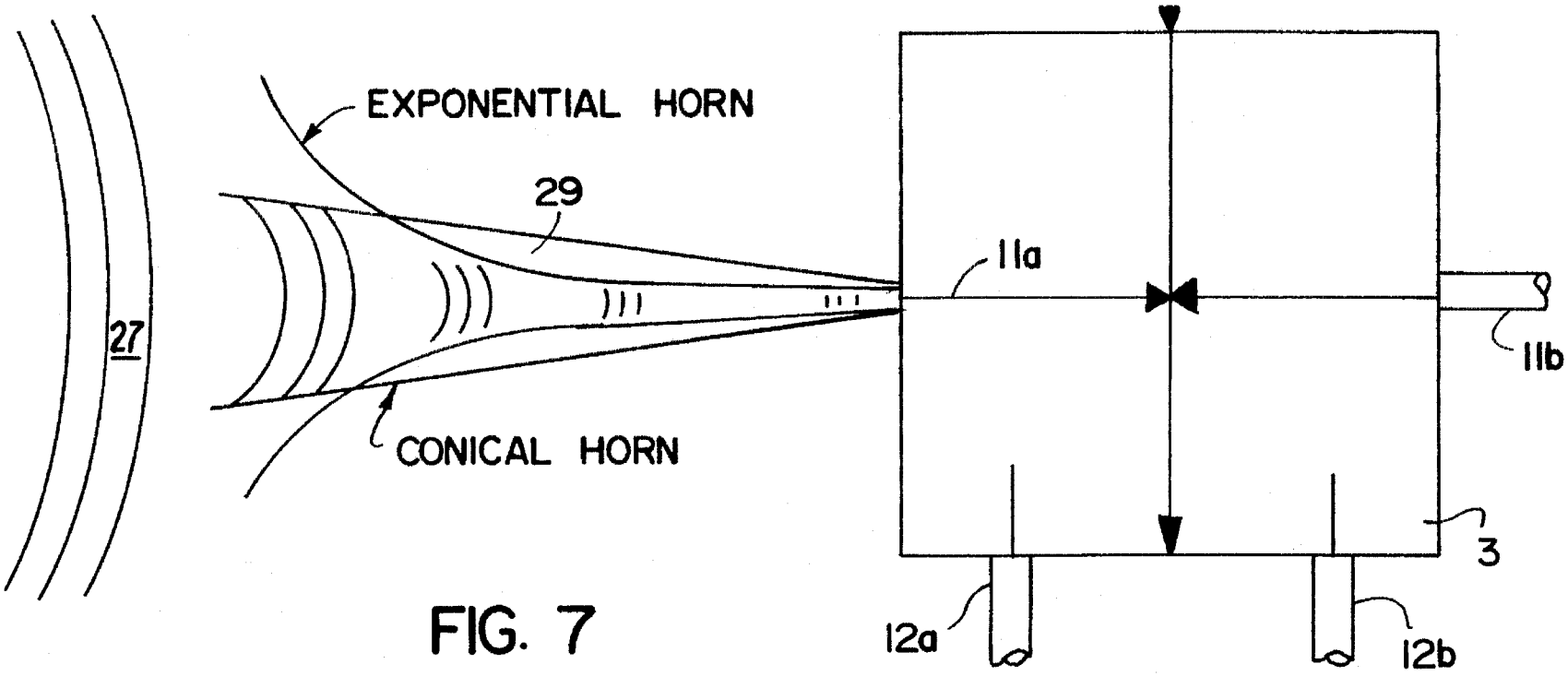
FIG. 7 is a schematic diagram illustrating exponential and conical horns for matching acoustic signals to an LPA according to the present invention.

Horns, either exponential or conical, act as transformers and convert pressure while preserving power. FIG. 7 illustrates a receiving horn 29 with a decreasing downstream cross-sectional area used to provide input acoustic signals to the inlet port 11*a* of an LPA. When used in this orientation, the horn increases the input pressure. The pressure gain of a horn is roughly the ratio of the inlet and outlet diameters, not counting mismatches. An exponential horn, because of its steep angle of convergence (i.e., high flare rate toward its wider input end), has few losses; therefore, such a horn serves as an excellent matching component for the amplifier.

Figure 8:
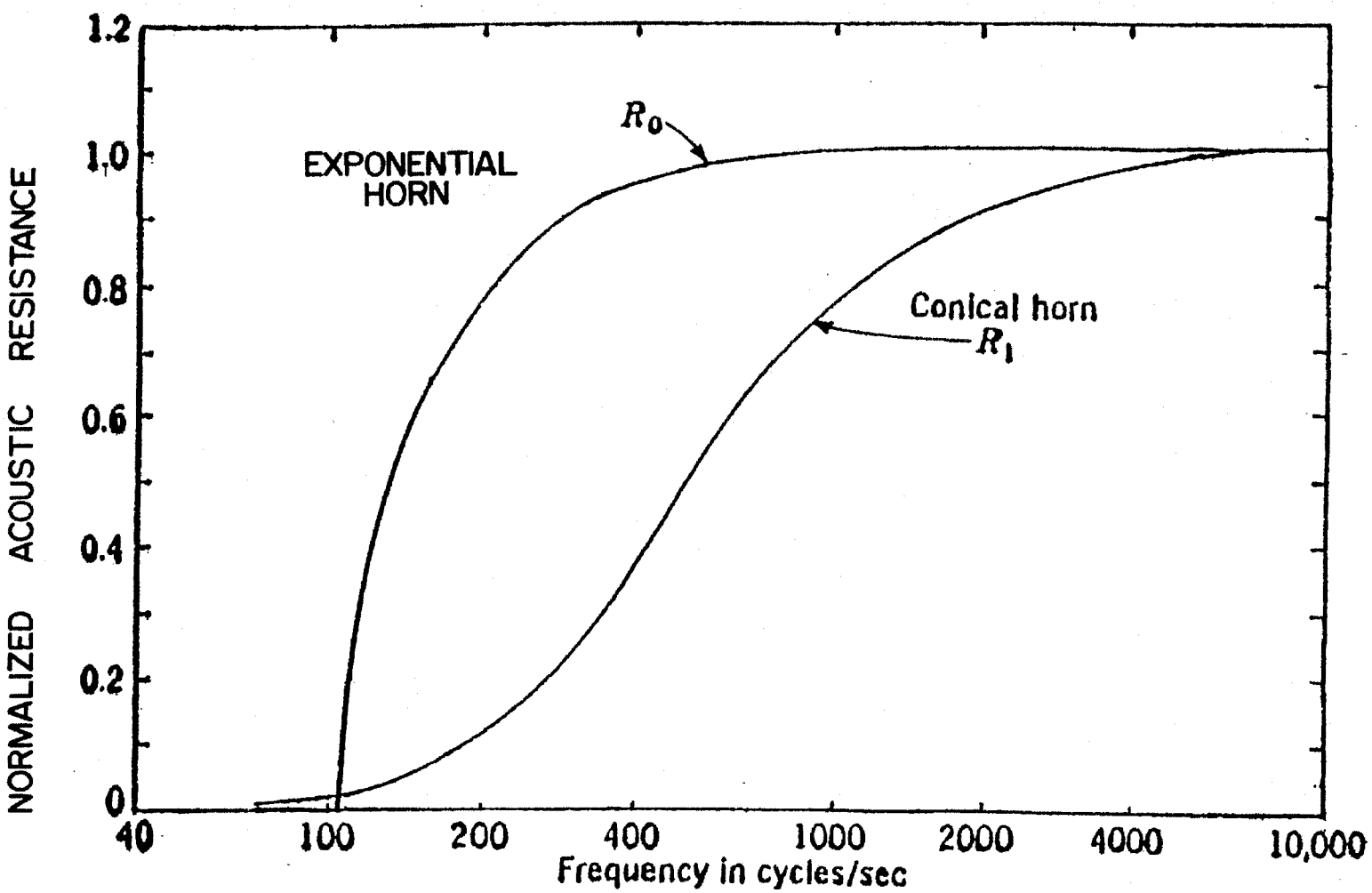
FIG. 8 is a plot of the frequency response of exponential and conical horns showing their cutoff frequencies below which signals cannot be transmitted.

The cutoff frequency (or point at which the acoustic impedance becomes infinite) of exponential and conical horns is shown in FIG. 8. The conical horn does not recover from the cutoff as well as the exponential horn but is significantly easier to manufacture. Cutoff frequency is basically proportional to the flare rate; the gentler the flare rate, the lower the cutoff frequency.

Figure 9:
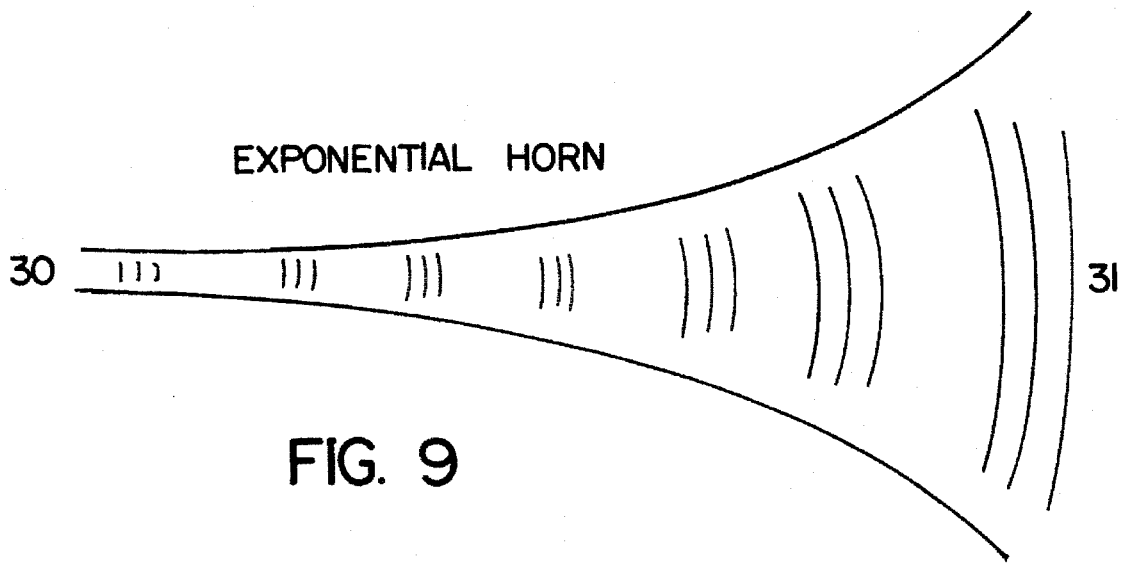
FIG. 9 is a diagram of an exponential horn used in the present invention to match amplified sound to the atmosphere.

Turning the horn around and passing the sound from the small end 30 to the flaring end 31 (as shown in FIG. 9), as with conventional horns, results in a pressure amplitude reduction also proportional to the ratio of end diameters. Typically, the exit diameter of an acoustic LPA is about one to two mm but the outlet diameter of a horn can be as high as 500 mm, resulting in a loss between 250 and 500 to one in pressure amplitude. The input horn may have a gain at most of about ten to one so that the fluidic amplifier itself must provide a gain of between 25 and 50 to one in excess of gain needed to broadcast which may be as much as 100 to one. To require a gain of about 5000 is, therefore, not unusual, but is very difficult to implement practically without resort to trim and continuous oversight.

Figure 10:
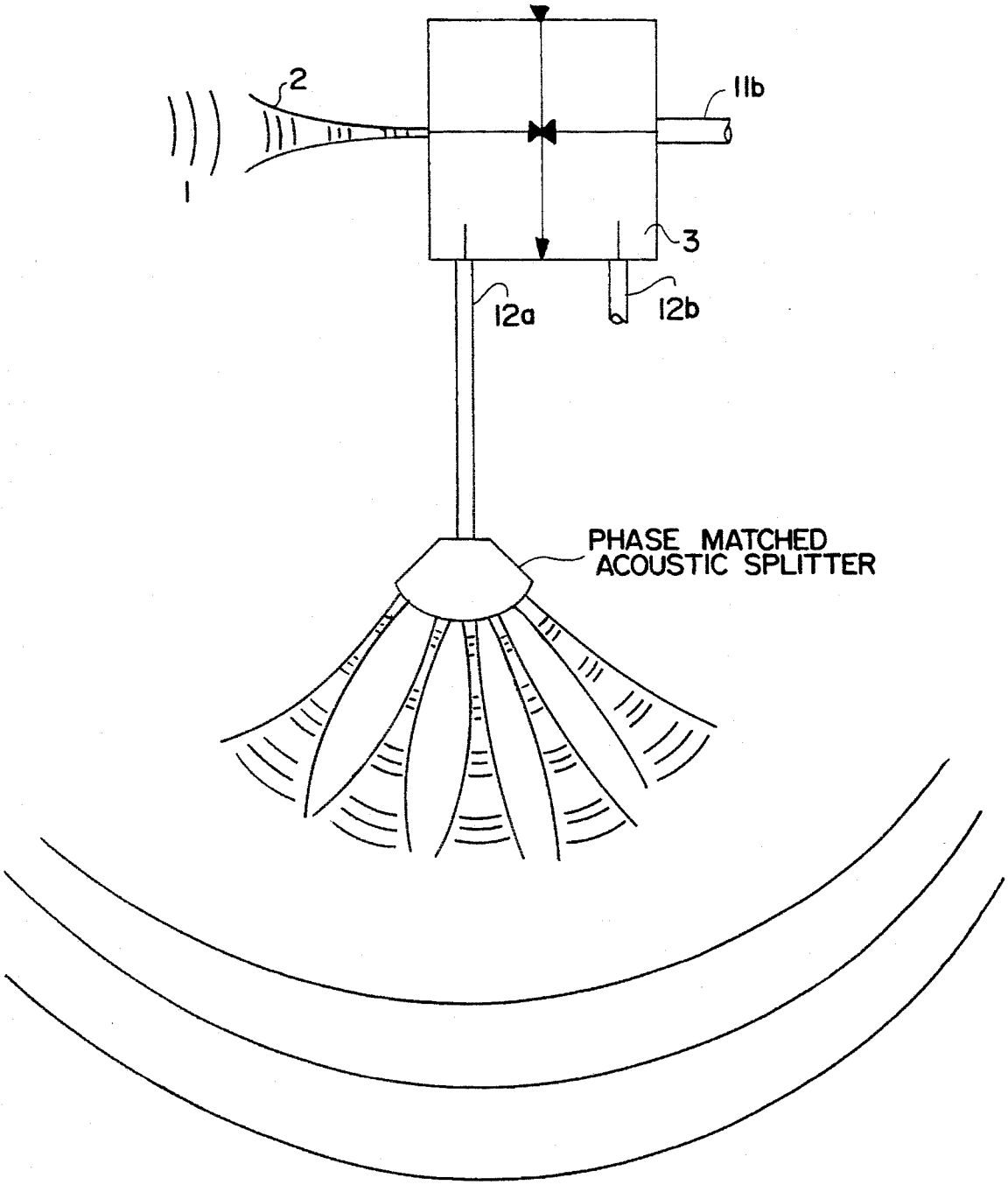
FIG. 10 is a schematic diagram of a phased array of fluidic output signals used to increase loudness.

As is pointed out in relation to FIG. 6, acoustic power output can be increased by paralleling multiple amplifiers. Loudness per se cannot be increased without providing for an increased pressure level. Therefore, in order to increase the loudness of a signal emanating from a small exit hole such as in a fluidic amplifier, the amount of divergence of the output horn must be minimized to provide a smaller outlet diameter. In so doing the spatial coverage is reduced; in other words the beam is narrowed and becomes more directional. However, by paralleling a number of amplifiers with small horns, as shown in FIG. 10, and assuring that the output signals are all in phase, the loudness is necessarily increased. When a single horn of 500 mm diameter is replaced by one hundred 50 mm diameter horns covering the same area, the loudness is increased tenfold, or by a factor of 20 dB. A similar effect can be developed by paralleling the output of 100 amplifiers to sum their output areas and in so doing increasing by a factor of ten the inlet diameter of the horn and consequently reducing the amplitude reduction.

Figure 11:
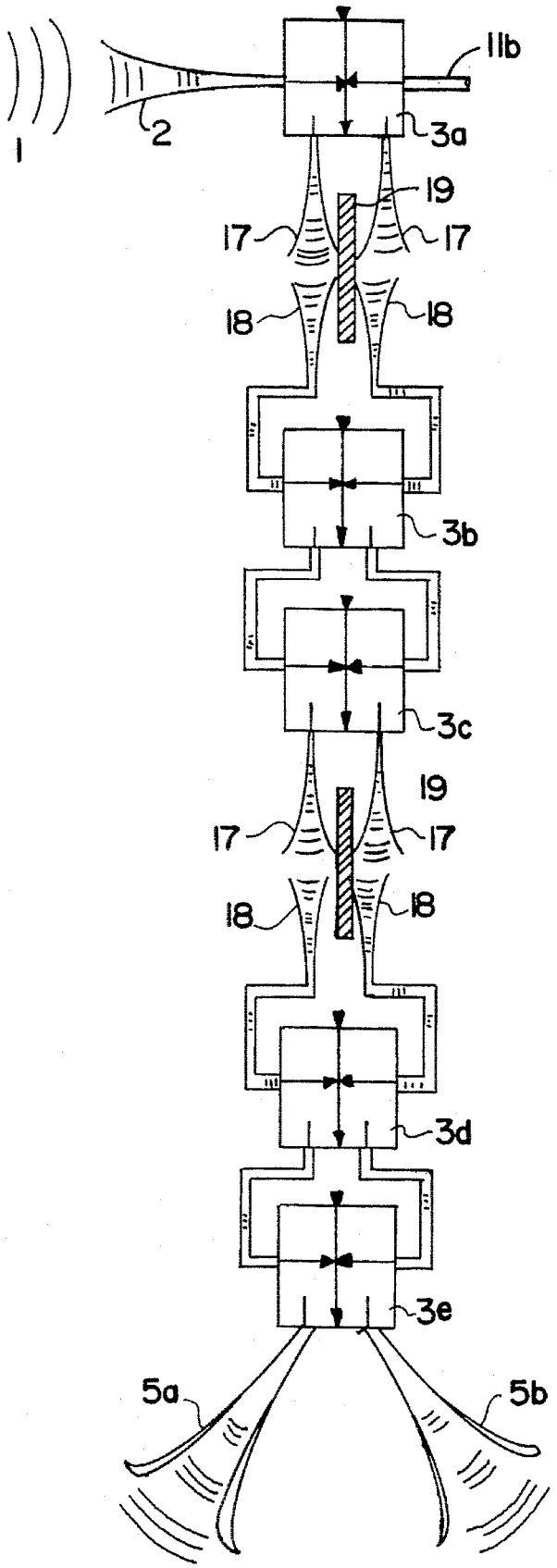
FIG. 11 is a schematic diagram of a dual-output fluidic audio amplification system configured as a public address system with the two oppositely phased output signals from a single final stage to provide near-field cancellation and far-field addition.

FIG. 11 shows a preferred embodiment of a single channel, dual output, public address, sound amplification system.

Input sound waves 1 impinge on an input horn 2 and are transmitted to a fluidic amplifier comprised of five cascaded stages of LPAs 3*a*, 3*b*, 3*c*, 3*d* and 3*e*. The first stage 3*a* may be a single 1010-type amplifier (the designation 1010 refers to a 10-mil wide 10-mil high nozzle standard LPA). Decoupling horns 17, 18 allow signals to be transmitted between stages one and two, and between stages three and four, without passing DC flow and null offset signals. Output exponential horns 5*a*, 5*b* at the last stage broadcast the amplified sound 180° out of phase from each other. This causes near-field cancellation such that when the speaker pair is situated near the sound source, audience members close to the source will hear the sound basically unamplified while those further from the source will receive the benefit of the amplification.

Figure 12:
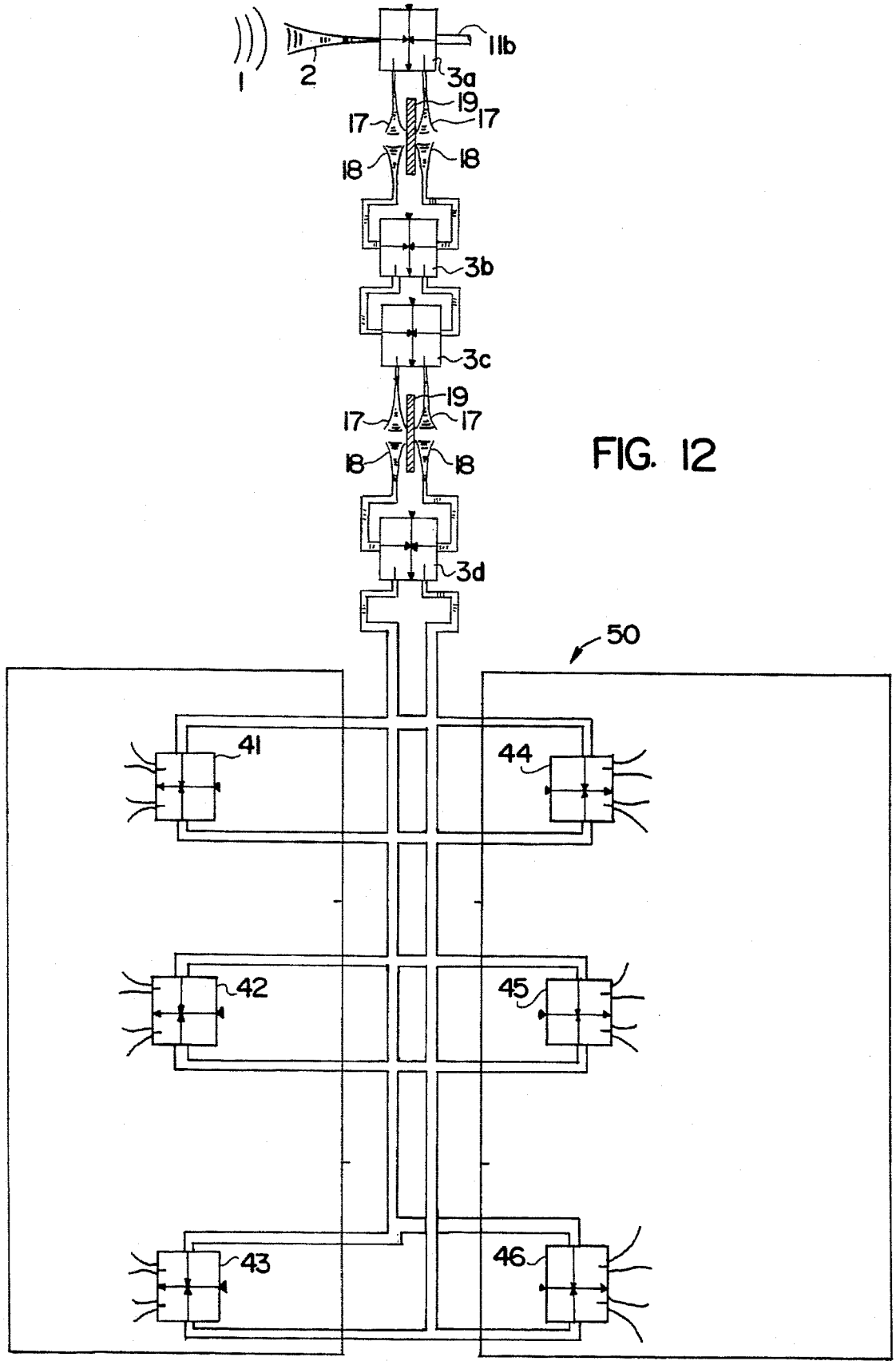
FIG. 12 is a schematic diagram of a fluidic audio amplification system configured with remotely located LPAs providing final stage amplification for separate output horns broadcasting to different areas of an auditorium.

The high fidelity sound amplification system described and illustrated herein need not necessarily deliver its amplified acoustic signal through large horns covering large areas of a room. Instead, the output acoustic signal may be delivered to multiple smaller horns distributed throughout a prescribed area. For example, individual small horns may be disposed above, below or adjacent individual seats or groups of seats in an auditorium. In this regard, reference is made to FIG. 12 depicting an amplification system corresponding to the first four stages illustrated in FIG. 11. Instead of a single fifth stage the differential output signal from the fourth LPA stage is directly coupled to each of six LPAs 41, 42, 43, 44, 45 and 46 connected in parallel. LPAs 41–46 are physically positioned at six different spaced locations in an auditorium 50 and each includes a pair of small output horns sized to broadcast an output signal over a relatively small assigned area surrounding the LPA. Thus, for example, LPAs 41–46 may be mounted on a column, suspended from the ceiling, recessed in the floor, etc., with their horns directed toward the localized areas to receive its signal.

From the foregoing description it will be appreciated that the invention makes available a novel method and apparatus for amplifying acoustic energy without utilizing electricity or moving mechanical parts. Amplification is achieved by cascaded fluidic laminar proportional amplifiers employing input and output acoustic horns matched to the amplifiers. Coupling between certain stages may be via separated horns thereby decoupling flow between the stages to prevent the effects of null offset from producing saturation in higher order stages by use of differential cancellation filters, or by paralleling multiple elements. Passive inertance, volume and resistance components may be directly coupled between stages to provide the desired frequency response, the components being adjustable to provide a fluidic equalizer.

Having described preferred embodiments of a new fluidic sound amplification and public address system, it is believed that other modifications, variations and changes will be suggested to those skilled in the art in view of the teachings set forth herein. It is therefore to be understood that all such variations, modifications and changes are properly within the scope of the present invention as defined by the appended claims.

What is claimed is:

1. A method of acoustically coupling first and second laminar proportional fluidic amplifiers (LPAs) comprising the steps of:

radiating an acoustic output signal from a first of said stages through an unconfined air space; and receiving the radiated acoustic output signal at the other of said LPAs from said space without direct connection and without direct coupling to said first LPA.

2. A method for fluidically amplifying sound comprising the steps of:

(a) splitting an input sound signal into first and second split signals;

(b) imposing a selected time delay on said first split signal;

(c) transmitting said time-delayed first split signal;

(d) transmitting said second signal undelayed;

(e) receiving said timed delay first signal at a laminar proportional fluidic amplifier (LPA), and splitting the received first signal into third and fourth signals;

(f) imposing a selected time delayed on said third split signal;

(g) transmitting said time delayed third signal;

(h) transmitting said fourth signal;

(i) receiving at a further LPA said second signal;

(j) splitting said second signal into fifth and sixth signals;

(k) imposing a selected time delay on said fifth signal;

(l) transmitting said fifth signal;

(m) transmitting said sixth signal;

(n) combining said fourth and fifth signals into a seventh signal; and (o) combining said third and sixth signals into an eighth signal; wherein said seventh and eighth signals correspond to output signals.

3. A fluidic sound amplification system comprising at least first and second laminar proportional fluidic amplifiers (LPAs) staged in sequence from an upstream unamplified input side to a downstream amplified output side; and acoustic coupling between said first and second LPAs including means for radiating output soundwaves from said first LPA through an unconfined open space and means for receiving said radiated soundwaves from said space as input soundwaves at said second LPA, wherein said acoustic coupling is devoid of any enclosed signal conduit for conducting said output soundwaves between said first and second LPAs.

4. The fluidic sound amplification system of claim 1 wherein at least one of said laminar proportional fluidic amplifiers is a differential amplifier.

5. The fluidic sound amplification system of claim 1 wherein at least one of said laminar proportional fluidic amplifiers is a single input-single output fluidic amplifier.

6. The fluidic sound amplification system of claim 1 wherein at least one of said laminar proportional fluidic amplifiers comprises multiple parallel differential amplifier channels.

7. The fluidic sound amplifier system of claim 1 wherein said means for radiating said output soundwaves includes at least one output horn.

8. The fluidic sound amplifier system of claim 7 wherein said at least one output horn is conical in shape.

9. The fluidic sound amplifier system of claim 7 wherein said at least one output horn is exponential in shape.

10. The fluidic sound amplifier system of claim 7 wherein said at least one input horn is exponential in shape.

11. The fluidic sound amplifier system of claim 1 wherein said means for receiving said input soundwaves includes at least one input horn.

12. The fluidic sound amplifier system of claim 11 wherein said at least one input horn is conical in shape.

13. The fluidic sound amplification system of claim 1 wherein the distance between said LPAs across said space is sufficient to dissipate DC flow.

14. A fluidic sound amplification system comprising:

a plurality of two channel differential laminar proportional fluidic amplifiers (LPAs) staged and acoustically coupled in adjacent sequence from an upstream unamplified input side to a downstream amplified output side;

at least a first of said LPAs having output two horns connected respectively to its two said channels for acoustically radiating signals, and at least a second of said LPAs adjacent and downstream of said first LPA having two input horns connected to its said two channels, respectively, for receiving respective signals radiated from said two output horns; and wherein said output horns ale separated from said input horns across an unconfined open space by a sufficient distance to dissipate DC flow from said output horns to said input horns.

15. The fluidic sound amplification system of claim 14 further comprising an acoustic separator disposed in said space for preventing cross-coupling between said acoustically radiated signals from said two output horns.

16. The fluidic sound amplification system of claim 15 wherein alternate pairs of adjacent LPAs in said sequence are acoustically coupled across respective unconfined open spaces by input and output horns, and wherein other alternate pairs of adjacent LPAs in said sequence are direct coupled by enclosed flow passages.

17. The fluidic sound amplification system of claim 1, wherein originating sound generated at one location is amplified by said system for broadcast over a prescribed area, said system further comprising:

additional cascaded stages of LPAs, a last LPA stage of which delivers a final amplified acoustic signal; and at least one last stage horn connected to said last LPA stage to radiate said amplified acoustic output signal throughout at least a portion of said prescribed area.

18. The fluidic sound amplification system of claim 17 further comprising near field cancellation means for broadcasting from said system, at a location proximate said one location, an acoustic signal 180° out-of-phase with said amplified acoustic output signal to cancel said amplified acoustic output signal and permit only the originating sound to be heard proximate said one location.

19. The fluidic sound amplification system of claim 17 wherein said additional cascaded stages include multiple parallel-connected last LPA stages each located in a respective section of said prescribed area, each last LPA stage delivering a respective final amplified acoustic output signal; and multiple last stage horns, each connected to a respective last LPA stage to radiate said amplified acoustic output signal from said respective last LPA stage throughout a respective section of said prescribed area.

20. A fluidic sound amplifier comprising a first differential laminar proportional amplifier (LPA) having means for splitting an input signal into a first and a second signal, means for imposing a selected time delay on said first split signal, a first output port for transmitting said time-delayed first signal and a second output port for transmitting said undelayed second signal;

a second differential LPA staged to receive said time delayed first signal and having means for splitting said time delayed first signal into a third and fourth signal, means for imposing a selected time delay on said split third signal, a third output port for transmitting said time-delayed third signal and a fourth port for transmitting said fourth signal;

a third differential LPA staged to receive said second signal and having means for splitting said second signal into a fifth and sixth signal, means for imposing a selected time delay on said split fifth signal, a fifth output port for transmitting said fifth signal and a sixth port for transmitting said sixth signal; and means for combining said fourth and fifth signals into a single seventh output signal and means for combining said third and sixth signals into a single eighth output signal.

21. A fluidic sound amplifier for receiving an input signal and producing an amplified signal free of DC null biases in a frequency band centered at a selected frequency comprising:

means for splitting said input signal into a first and a second input signal;

means for conducting said first signal to the left input port of a first differential laminar proportional amplifier and said second signal to the right input port of said first amplifier;

means for effecting a 180° phase delay at a selected frequency in said second signal arriving at said first amplifier right input port relative to said first signal arriving at said first amplifier left input port;

means for splitting the left output signal of said first amplifier into a third and a fourth input signal;

means for splitting the right output signal of said first amplifier into a fifth and a sixth input signal;

means for conducting said third signal to the left input port of a second differential laminar proportional amplifier and said fourth signal to the right input port of said second amplifier;

means for conducting said fifth signal to the left input port of a third differential laminar proportional amplifier and said sixth signal to the right input port of said third amplifier;

means for effecting a 180° phase delay at said selected frequency in said third signal arriving at said second amplifier left input port relative to said fourth signal arriving at said second amplifier right input port;

means for effecting a 180° phase delay at said selected frequency in said sixth signal arriving at said third amplifier right input port relative to said fifth signal arriving at said third amplifier left input port;

means for combining said second amplifier left output signal with said third amplifier left output signal; and means for combining said second amplifier right output signal with said third amplifier right output signal.

22. The fluidic sound amplifier system of claim 21 wherein said 180° phase delays are effected by selectively varying the difference in path lengths through which signals are conducted to left and right input ports.

23. The fluidic sound amplification system of claim 22 wherein said difference in path lengths for said 180° phase delay is determined according to the equation $\Delta L_{180}=(2n-1)c/2f$ where $\Delta L_{180}$ is said path length difference, c is the speed of sound, n is the harmonic number and f is said selected frequency.

24. A fluidic sound amplification system having a first and a second fluidic sound amplifier according to claim 16 for receiving an input signal and producing an amplified signal having a near uniform frequency response free of DC null biases across a frequency band centered at a selected frequency comprising:

means for splitting said input signal into a first and a second input signal;

said first fluidic sound amplifier having a 180° phase delay at said selected frequency;

said second fluidic sound amplifier having a 360° phase delay at said selected frequency;

means for conducting said first input signal to said first amplifier and said second input signal to said second amplifier; and means for combining the output signals of said first and said second sound amplifiers.

25. The fluidic sound amplification system of claim 24 wherein said phase delays are effected by selectively varying the difference in path lengths through which signals are conducted to left and right input port.

26. The fluidic sound amplification system of claim 25 wherein said difference in path lengths for said 180° phase delay is determined according to the equation $$\Delta L_{180} = (2n-1)c/2f$$

where $\Delta L_{180}$ is the path length difference, c is the speed of sound, n is the harmonic number and f is said selected frequency.

27. The fluidic sound amplification system of claim 25 wherein said difference in path lengths for said 360° phase delay is determined according to the equation $$\Delta L_{360} = (2n)c/2f$$

where $\Delta L_{360}$ is the path length difference, c is the speed of sound, n is the harmonic number and f is said selected frequency.

28. A fluidic sound amplification system comprising:

first and second laminar proportional fluidic amplifiers (LPAs) each comprising at least a first input port for receiving an acoustic input signal and at least a first output port for providing a first acoustic output signal representing an amplified version of said acoustic input signal;

means acoustically coupling said first and second LPAs by positioning the first output port of said first LPA in physically spaced relation to said first input port of said second LPA across an open unconfined air space such that said first acoustic output signal from said first LPA is radiated through said unconfined air space and received as an acoustic input signal by the first input port of said second LPA.

29. The system of claim 28 further comprising:

a first outlet horn connected to said first output port of said first LPA for radiating said first acoustic output signal into said unconfined air space; and a first inlet horn connected to the first input port of said second LPA for receiving the first acoustic output signal from said first LPA across said unconfined air space.

30. The system of claim 29 wherein said first LPA includes a second output port and a second outlet horn connected to said second output port, the first and second output ports of said first LPA being arranged to provide a differential pressure output signal thereacross proportional to the acoustic input signal received at the input port of said first LPA;

wherein said second LPA includes a second input port and a second inlet horn connected to said second input port, said first and second input ports of said second LPA being arranged to provide a differential pressure input signal to said second LPA;

wherein said second inlet horn is positioned in spaced relation to the second outlet horn across said unconfined air space such that acoustic signals radiated through said unconfined air space from said second outlet horn are received as acoustic input signals by said second inlet port.

31. The system of claim 30 further comprising an acoustic separator disposed in said unconfined air space for preventing cross-coupling between said acoustic signals radiated from said first and second outlet horns of said first LPA.

* * * * *